United States Patent [19]

Hruda

[11] 4,216,359

[45] Aug. 5, 1980

[54] LOW VOLTAGE VACUUM SWITCH AND OPERATING MECHANISM

[75] Inventor: Robert M. Hruda, Horseheads, N.Y.

[73] Assignee: Westinghouse Electric Corp., Pittsburgh, Pa.

[21] Appl. No.: 915,324

[22] Filed: Jun. 13, 1978

Related U.S. Application Data

[63] Continuation-in-part of Ser. No. 650,406, Jan. 19, 1976, abandoned, and Ser. No. 650,322, Jan. 19, 1976, abandoned.

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 4,075,448 | 2/1978 | Seedorf et al. | 200/144 B |
| 4,088,859 | 5/1978 | Hruda | 200/144 B |

*Primary Examiner*—Robert S. Macon

*Attorney, Agent, or Firm*—W. G. Sutcliff

[57] ABSTRACT

A low voltage vacuum switch and operating mechanism is detailed which is readily used as a shorting switch arrangement in electrolytic cells between the high current carrying bus bars of the cell. The switch has a very low profile and axial contact travel distance and is opened and closed by a means which translates rotational motion to a generally axial contact movement via a cam and connecting member, with overtravel dished washer spring means provided to keep the contacts closed until a positive opening force is applied. The low voltage vacuum shorting switch is detailed with axially movable non-weld contacts. The switch has a compact, rugged design for use in low voltage, high current severe environment application. A pair of thin flexible annular members having annular corrugations formed therein permit axial movement of the contacts.

13 Claims, 3 Drawing Figures

FIG. 3
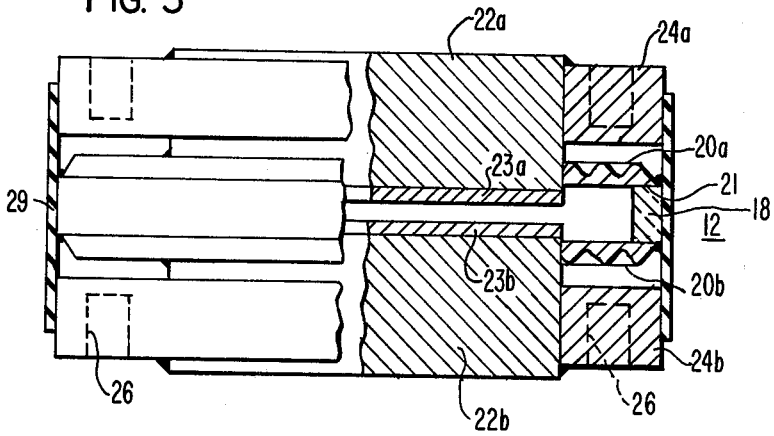
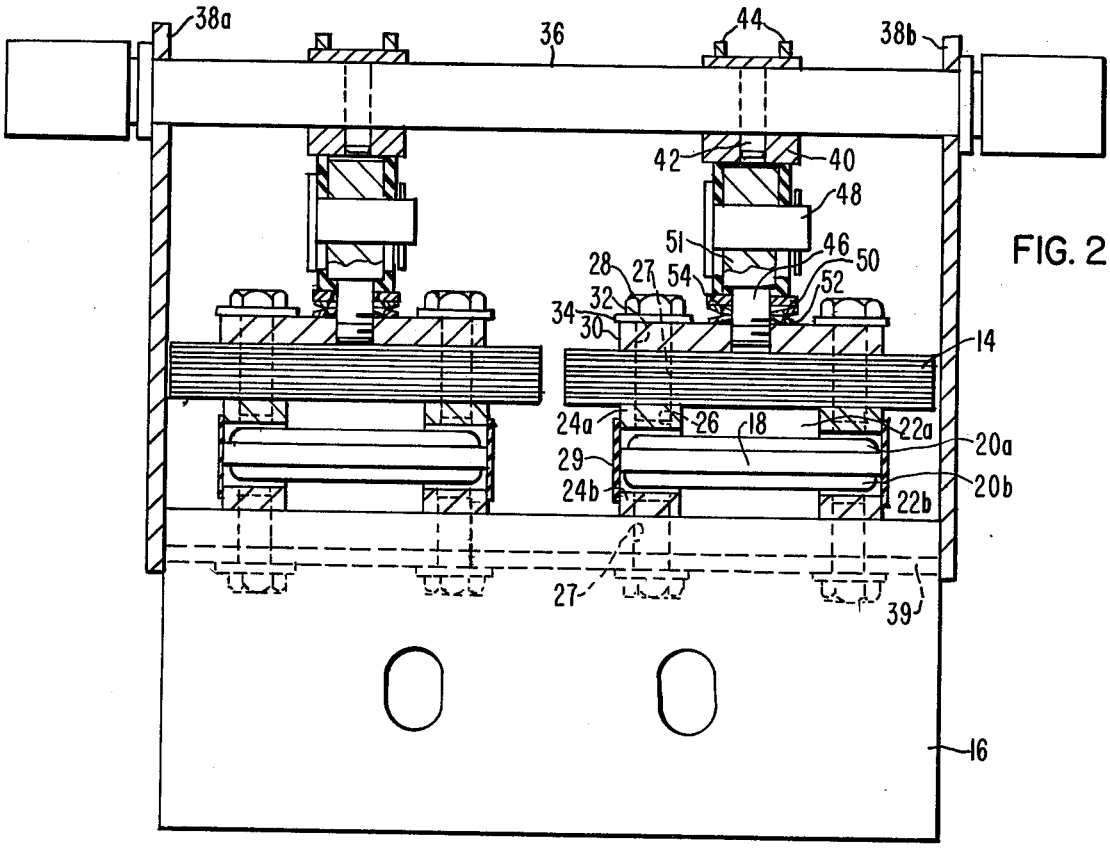
FIG. 2

LOW VOLTAGE VACUUM SWITCH AND OPERATING MECHANISM

CROSS REFERENCE TO RELATED APPLICATIONS

This application is a continuation-in-part of both applications Ser. No. 650,406 and Ser. No. 650,322, both filed Jan. 19, 1976 now abandoned, and merges the subject matter of these applications into a single application.

BACKGROUND OF THE INVENTION

The present invention is a low voltage vacuum shorting switch, which is compact and rugged, and is particularly adapted for use in severe environments, such as in electrochemical processing plants.

Vacuum switches are well known in the art and generally comprise an insulating body through which movable contacts are sealed. At least one of the contacts or contact supports have some sort of flexible member between the contact and the sealed switch body to permit contact movement. A bellows-type shorting switch is detailed (in copending application Ser. No. 513,788, filed Nov. 10, 1974) in U.S. Pat. No. 3,950,628, issued Apr. 13, 1976, and owned by the assignee of the present invention.

Such low voltage switches are generally intended for use in electrochemical processing plants, such as chlorine plants. The low voltage switch is connected between high current carrying buses which supply current through a chemical solution. The buses pass through numerous chemical solution cells or tubs, and from time to time it is necessary to bypass a particular cell without interrupting the entire operation. The low voltage switch permits shorting out the bus at selected locations to permit maintenance operations.

It is important that opposed ends of the low voltage vacuum switch be easily connectable to the massive bus bars, with a large contact surface area to handle several thousand amperes of current. The typical electrochemical plant application means that the switch is used in a highly corrosive environment. The flexible member used to permit contact movement must be able to withstand this corrosive environment. The flexible member must permit the requisite axial movement of the contacts to permit bringing the contacts together to their shorted or closed position. The flexible member should also permit some flexibility at an angle to the axis to facilitate breaking the contacts apart when opening them, and also to facilitate mounting of the switch between the massive bus bars.

The present low voltage vacuum switch and operating mechanism combination is particularly useful in electrolytic chemical processing plants where large numbers of shorting switches are required for maintenance operations. These shorting switches are disposed between massive bus bars which connect chemical cells together, with the buses carrying thousands of amperes of current at low DC voltage levels. Periodic maintenance of the individual cells requires shorting the buses at the individual cell location. Such shorting assemblies are used with mercury cells for chlorine production or a variety of other electrolytic cells.

It has been the practice to use conventional knife-blade or exposed shorting contacts with the contacts being exposed to the corrosive chemical environment found in the vicinity of the cell. It is important that the shorting switch be located close to the cell to minimize resistance losses associated with long leads. It is also difficult to synchronize the mechanical closing of a group of shorting switches which may be in parallel groupings to handle the very large interrupting currents.

SUMMARY OF THE INVENTION

A low voltage vacuum shorting switch in which the contacts are supported on movable cylindrical, conductive support posts which are sealed through thin flexible, annular members which flex to permit axial post movement. The flexible annular members are sealed to opposed ends of an insulative body ring, with the flexible annular members extending generally in a direction normal to the longitudinal axis of the body ring. The annular members have a plurality of annular corrugations formed therein to provide the requisite degree of flexure to permit opening and closing the switch.

A low voltage vacuum switch and operating mechanism in which at least one vacuum switch having a short axial travel is disposed between bus connection means. One of the bus connection means has a flexible portion to permit the switch contact travel. The switch contacts are axially moved by a shaft having a cam means mounted thereon, which cam means reciprocates an insulating connecting means which bears on overtravel dished spring washer means atop the flexible bus connector, the underside of which bears on the movable contact support extending from the switch. The rigid bus connector contacts the opposed switch contact support post and a rigid frame means extends between the shaft and this rigid bus to support the opposed switch contact support post so that the axial force is effective to open and close the axially movable contacts.

BRIEF DESCRIPTION OF THE DRAWINGS

FIG. 2 is a side elevational view of the combination of FIG. 1, partly in section, viewed from the left to right of the combination viewed in FIG. 1; and FIG. 3 is a side elevational view partly in section of the low voltage vacuum switch of the present invention.

DESCRIPTION OF THE PREFERRED EMBODIMENTS

Figure 1:
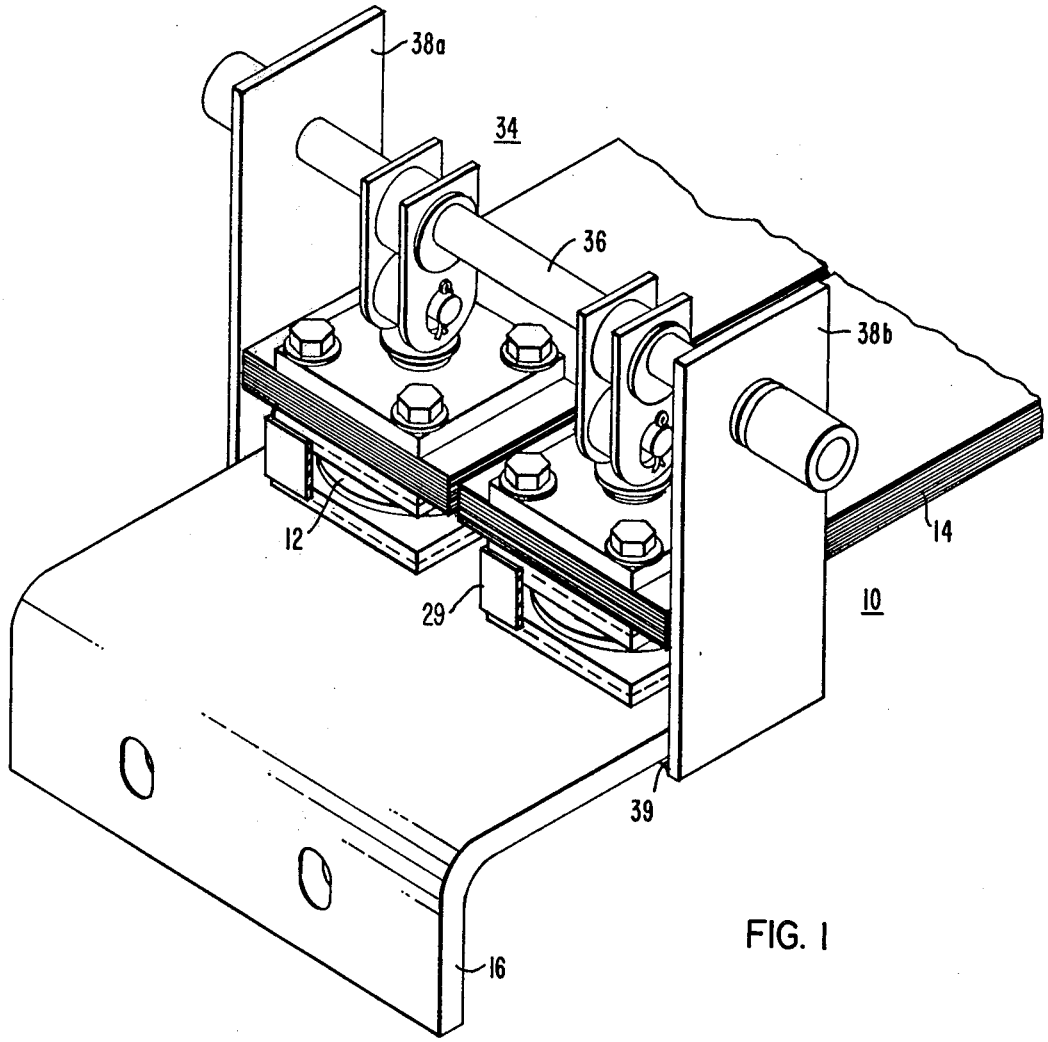
FIG. 1 is a perspective view of the switching means and operating mechanism combination.

The vacuum shorting switch and operating mechanism combination 10 seen in FIGS. 1 and 2 has two parallel connected vacuum shorting switches 12, the upper contact of each shorting switch is connected to a flexible bus bar 14, while the lower contact of each shorting switch is connected to another bus bar 16. These bus bars 14 and 16 are then connectable to the buses of the particular system into which the combination is placed.

The low voltage vacuum switch 12 is a low profile high surface contact area shorting switch. This switch 12 is best seen in FIGS. 2 and 3. The low voltage vacuum shorting switch 12 comprises the insulative ceramic body ring 18 which electrically isolates one end of the switch from the other. The opposed end surfaces of the insulative body ring 18 are metallized by a conventional process, and the pair of thin, flexible, annular members **20*a*, 20*b* are sealed to the metallized end surface. The annular members 20a, 20b are 12 mil thick "Monel" metal members which have a plurality of annular corrugations 21 formed therein. By way of example, the inner diameter of annular members 20a, 20b is about 2.375 inches and the outer diameter is 3.750. The annular corrugations are about 0.06 inch deep. The outer perimeter portion of the flexible annular members 20a, 20b is brazed to the metallized coating on the insulating body ring. The inner perimeter portion of the annular flexible members 20a, 20b is brazed to the respective cylindrical conductive support post 22a, 22b which passes through the flexible annular members 20a, 20b**. The centrally disposed insulative body ring, the flexible annular member and the cylindrical conductive support posts comprise a hermetically sealed envelope for the vacuum switch. The switch is assembled with braze material rings disposed between the seal surfaces, and the switch is placed in a vacuum furnace. The switch is evacuated and the temperature is raised above the braze melting point and then lowered to effect the hermetic seal.

Non-weld material contact discs 23a, 23b are disposed on the interior end surfaces of the support posts 22a, 22b. The support posts are typically copper, and the contact discs are a copper-bismuth conventional non-weldable material. Planar mounting plates 24a, 24b, having support posts receiving apertures therethrough are brazed to the support posts proximate the exterior extending ends of the support posts. The support posts protrude a small distance from the planar mounting plates, for example about 0.02 inch. A plurality of threaded apertures 26 are provided in the corners of the generally square mounting plates 24a, 24b.

A plurality of apertures 27 are provided in the respective buses 14 and 16 to permit mounting bolts 28 to extend therethrough, which bolts thread tight into the threaded apertures 26 in the mounting members. A mounting plate 30 is also disposed on the other side of bus 14, and has apertures 32 aligned with the bus apertures and the threaded mounting plate apertures. The mounting bolts 28 are tightened down on this mounting plate 30 and washer 34 may be used to distribute the mounting bolt hold-down force. The planar end surface of the conductive support post contacts the respective bus 14 or 16 to electrically connect the switch to these bus connectors. This connection is clearly shown for bus 14, and a rigid cross-piece 39 extends between the frame members 38a, 38b to support bus 16 and the switch via bolts which thread into the mounting plate 24b. It is the protruding support post which actually makes electrical contact with the bus. The support post is preferably of oxygen free high conductivity copper which is in a soft state to ensure mating of the end surface with the bus for good electrical contact.

An elastomeric, insulative member 29, seen in section in FIGS. 2 and 3 and broken away in FIG. 1, is tightly fitted over the side walls of the mounting plates to effectively shield the ceramic body ring and the seal areas of the switch, particular the seals of the flexible annular member, from the corrosive environment of the processing plant.

An axial force is applied to the low voltage switch support posts to either move them together and close the contacts in mating engagement, or to move them apart. The corrugated flexible annular members provide the requisite flexibility for such axial movement. The flexible annular members also permit some slight cocking of the support posts and contact surfaces to facilitate breaking welds which may form between the contacts. The fact that the annular member extends generally normal to the switch axis which is the direction of contact movement keeps this off axis cocking to a minimum but still permits it for breaking welds. With prior art bellows sealed switches it was possible for the contact surface to engage at a considerable angle, which is not desired, since such a premature small area of contact could be damaged by the large current density which would be present. High localized currents flowing in a small contact area could vaporize that portion of the contact damaging the contact and perhaps shorting the switch along the insulating ring.

The use of flexible annular members at both ends of the switch provides twice the travel for a given drive force. The annular corrugations reduce the axial force requirements and stresses while providing a stiff member in the transverse direction, i.e. the direction normal to the switch travel axis. This reduces the need for positive alignment of the contact means.

The flexible bus 14 is formed of a plurality of thin copper sheets which are bonded together at the extending ends of the bus, but are not bonded together at a median area to permit flexure of bus 14 to permit movement of the support posts to open and close the contacts within the switch.

The operating mechanism 34 is designed to provide the axial force needed to move the support posts and to mate the contacts closing the switch, and to move them apart opening the switch.

The operating mechanism 34 is designed to operate the parallel switches at the same time, and can be ganged to be simultaneously driven and operated with other groups of switches. A rotatable shaft 36 is supported by spaced apart frame members 38a, 38b. The shaft 36 has eccentric cam members 40 mounted on the shaft 36 by a holding pin 42 so that the cam 40 turns with the shaft 46. Insulating connecting plates 44 are spaced apart and have cam receiving apertures provided therethrough. The cam 40 is rotatable within the aperture in the connecting plate to produce reciprocal movement of the connecting member along the axis of the switch.

The mounting plate 30 has an eye-bolt 46 centrally mounted on plate 30 extending upward, and the eye-bolt fits between the spaced apart connecting plates 44. Apertures are provided in the spaced apart connecting plates aligned with the eye-bolt and a connecting pin 48 is fitted through the aligned apertures. The aligned apertures are elongated in the vertical direction so that the pin can move up and down as the connecting member moves.

The connecting plates 44 have arcuate bottom ends 54 which seat on a enlarged washer 50 which is disposed below the eye portion 51 of the eye-bolt. A plurality of dished washers 52, i.e. Belleville washers, are disposed under the enlarged washer 50 to act as an overtravel spring means as will be explained. The dished washers 52 sit atop the mounting plate 30.

When the vacuum shorting switches are to be closed the shaft is rotated and the rotated eccentric will cause the connecting plates to be displaced with the arcuate bottom ends rocking on the washer 50 to transmit the axial closing force to the support posts. In the embodiment seen in the Figures, the switches are closed, with the major axis of the cam aligned vertically with the switch axis. The central portion of the arcuate end of the connecting plates is likewise vertically aligned with the switch axis and the connecting pin 48 is at the bottom end of the elongated apertures through the connecting plates. The switch closing force is thus the additive force of the vacuum within the switch, and the axial force imparted from the connecting member to the overtravel dished washers to the mounting plate.

With the major axis of the cam aligned vertical with the switch axis no external force need be maintained on the shaft to keep the switch in the closed position. It takes a positive action rotating the shaft to overcome the closing force maintained by the overtravel dished washers in order to open the contacts. The connecting members move upward and the connecting pin pulls the eye-bolt to open the switch.

The connecting plates are formed of electrical insulating material to electrically isolate the switch and the bus from the operating shaft. The off-center pull between the cam surface and eye-bolt transmitted through the connecting plates produces a slight rocking action on the switch contacts as the shaft is rotated back to the open position to facilitate breaking any welds that may tend to form between the planar contacts within the switch. The flexible bus 14 flexes enough to permit the opening and closing travel of the contacts, which can be for example about ⅛ inch. The bus 14 is rigid enough to ensure that the opening and closing force as well as the support post movement is substantially axial. This prevents non-symmetric stressing of the annular corrugated flexible members of the switch.

The eccentric cam design and orientation can be readily varied to adjust the travel as well as whether the switch is to be normally open as described above or normally closed.

The flexible bus 14 can be made with an S-shaped configuration having fuse welded ends with individual sheets at the median portion. This can be accomplished by taking a stack of thin copper sheets and clamping the ends together while heating under pressure to effectively fuse weld the ends to form essentially solid ends which are more effective current carrying members than the individual median sheets which provide the needed flexibility. The copper sheets ends can be effectively clamping by providing apertures through the sheets and providing bolts therethrough of a high strength material that has a lower coefficient of expansion than the copper, such as steel. The pressure exerted between the heated sheets acts to fuse weld them together where the clamping pressure is maintained.

A preferred method of fabrication of the low voltage vacuum switch of the present invention is to provide a small diameter chamber in the central inward terminal end of one support post, and to include a small titanium ribbon within this chamber. A small aligned aperture is provided through the contact disc which is brazed to the support post during sealing. The entire switch is placed in a vacuum furnace, and the air in the furnace is displaced with nitrogen, and the nitrogen then displaced with hydrogen. The hydrogen continues to flow through the system and enters the switch because the braze rings separate the parts enough for gas to enter and be removed from the interior of the switch. The furnace is activated and as the system heats up the titanium ribbon absorbs a significant amount of hydrogen as the titanium passes through its gettering temperature range. Thereafter, as the temperature is increased the titanium releases hydrogen resulting in a further purge of the interior of the switch so that essentially only hydrogen remains. The braze rings then melt and effectively seal the switch. The furnace temperature is then reduced and the hydrogen within the switch is again effectively gettered by the titanium to produce the resultant low vacuum in the sealed switch.

A preferred contact structure and method of fabrication has also been provided. It has been the practice to braze a sintered thin disc of copper-bismuth non-weld contact material to the end of the copper support post. One problem is that the braze material has a tendency to infiltrate into this thin contact material disc diminishing its non-weld characteristic. It has been discovered that providing a thin barrier layer on one side of the copper-bismuth disc will prevent infiltration of the braze into the contact per se. Such a barrier layer can be a thin deposit of nickel or copper of about a mil thickness, which can be vacuum or electrodeposited.

A preferred barrier layer is provided by pressing the admixed copper and bismuth powder upon a copper foil disc which is about 1–10 mils thick. This pressed compact on the foil can then be sintered as normally, and thereafter brazed to the support post during final sealing of the switch. The thin copper foil barrier layer prevents filtration of the braze into the copper-bismuth contact.

I claim:

1. A low voltage vacuum switching means and operating mechanism combination comprising:

(a) at least one low voltage vacuum switch having axially movable conductive support posts sealed to and extending through opposed flexible annular seal members, with electrical contact portions provided at the inwardly extending ends of the support posts within the vacuum switch, and wherein the flexibility of the annular seal members permits axial movement of the support posts to move the electrical contact portions into and out of electrical contact;

(b) mounting means connected to the opposed extending ends of the respective support posts outside the vacuum switch, which mounting means permit electrical connection of the switch to electrical conductor means, with the mounting means connected to the support post on the side of the switch connected to an operating mechanism including a mounting means flexible portion, and the mounting means on the other side of the switch being rigid relative to the mounting means flexible portion;

(c) an operating mechanism connected via the mounting means flexible portion to the extending end of a support post on one side of the switch, which operating mechanism comprises means for translating a rotary actuating force to an axially directed reciprocal switch closing force for axially flexing the annular seal members and reciprocally moving the support posts to effect opening and closing the switch contact portions.

2. The combination specified in claim 1, wherein a plurality of low voltage vacuum switches are disposed in side by side relation and connected electrically in parallel by the mounting means to the operating mechanism for simultaneous opening and closing.

3. The combination specified in claim 1, wherein the rotary opening and closing force is provided by a rotatable shaft, with the shaft having an eccentric member mounted thereon which is coupled to connection plates whereby the rotary force is translated to an axial reciprocal opening and closing force.

4. The combination specified in claim 3, wherein the connection plates are electrically insulating material.

5. The combination specified in claim 3, wherein the eccentric member is rotatably mounted in apertures in spaced apart connecting plates whereby rotation of the shaft and eccentric produces reciprocal movement of the connecting plates.

6. The combination specified in claim 3, wherein the terminal ends of the connecting plates bear on a mounting means plate coupled to a flexible bus coupled to the conductive support post of the switch, and a connecting pin extends between the connecting plates proximate the terminal ends, which connecting pin engages means connected to the mounting means plate to permit axial switch opening force to be exerted on the support post.

7. The combination specified in claim 3, wherein the terminal ends of the connecting plates bear on overtravel dished spring washer means disposed on the mounting means plate.

8. The combination specified in claim 3, wherein the major axis of the eccentric member is rotatable to be aligned with the vacuum switch axis when the switch is closed.

9. A low voltage vacuum shorting switch having contact surface area large enough for switching the low DC voltage, at least several thousand ampere operating current for an electrolyte cell across which the switch is connectable, which switch comprises:

(a) an insulative body ring;

(b) a pair of thin flexible annular members, the outer perimeter of each annular member sealed to opposed ends of the insulative body ring, which annular members are disposed generally in a direction normal to the longitudinal axis of the body ring, and wherein the annular member has a plurality of annular corrugations formed therein;

(c) a pair of cylindrical conductive support posts aligned along the insulative ring longitudinal axis, which posts pass through and are circumferentially sealed to the inner perimeter of the respective annular members through which the post passes;

(d) planar contacts disposed at each inwardly extending end of the support posts, which contacts are spaced apart within the evacuated switch when the switch is open, which contacts are brought into contact by axial relative movement of the support posts;

(e) planar mounting plates at opposed switch ends, with centralized apertures through the mounting plates and with the respective support posts extending through the mounting plate aperture, and the support post is brazed to the mounting plate.

10. The shorting switch specified in claim 9, wherein the thin flexible annular corrugated members are thin metal members.

11. The shorting switch specified in claim 9, wherein the planar contacts are thin discs brazed to the ends of the cylindrical conductive posts, and are formed of non-weld contact material.

12. The shorting switch specified in claim 9, wherein a metallized coating is provided on the opposed ends of the insulative body ring and this metallized coating is brazed to the outer perimeter of the annular members.

13. The shorting switch specified in claim 9, wherein an elastomeric, insulative member is tightly fitted over the sides of the planar mounting plates to shield the flexible annular members and the insulative body ring from the environment.

* * * * *